US008756716B2

(12) United States Patent
Jordan et al.

(10) Patent No.: US 8,756,716 B2
(45) Date of Patent: Jun. 24, 2014

(54) GARMENT POCKET SYSTEM FOR SECURELY HOLDING PERSONAL ITEMS WITH EASY ACCESS

(75) Inventors: Scott Jordan, Ketchum, ID (US); Christian Payne, St. Neots (GB)

(73) Assignee: Scottevest, Inc., Ketchum, ID (US)

( * ) Notice: Subject to any disclaimer, the term of this patent is extended or adjusted under 35 U.S.C. 154(b) by 98 days.

(21) Appl. No.: 13/612,531

(22) Filed: Sep. 12, 2012

(65) Prior Publication Data

US 2014/0068832 A1 Mar. 13, 2014

(51) Int. Cl.
*A41D 27/20* (2006.01)
*A41D 1/00* (2006.01)

(52) U.S. Cl.
CPC ..... *A41D 1/005* (2013.01); *A41D 1/002* (2013.01)
USPC ..... 2/247

(58) Field of Classification Search
USPC ..... 2/247, 249–254, 69, 94, 108, 115; 381/301, 374, 388; 361/679.01, 679.03
See application file for complete search history.

(56) References Cited

U.S. PATENT DOCUMENTS

| | | | | |
|---|---|---|---|---|
| 4,539,700 | A | 9/1985 | Sato | |
| 4,589,134 | A | 5/1986 | Waldron | |
| 4,825,471 | A | 5/1989 | Jennings | |
| 4,876,724 | A | 10/1989 | Suzuki | |
| 5,361,412 | A | 11/1994 | Perry | |
| 5,509,147 | A | 4/1996 | Busquets | |
| 5,572,401 | A * | 11/1996 | Carroll | 361/679.03 |
| 5,893,991 | A | 4/1999 | Newell | |
| 6,826,782 | B2 | 12/2004 | Jordan | |
| 7,168,098 | B2 * | 1/2007 | West | 2/93 |
| 7,265,970 | B2 * | 9/2007 | Jordan | 361/679.27 |
| RE40,613 | E | 1/2009 | Jordan | |
| 7,992,225 | B2 * | 8/2011 | Demus | 2/247 |
| 8,549,670 | B2 * | 10/2013 | Demus | 2/247 |
| 8,613,112 | B2 * | 12/2013 | Santucci et al. | 2/69 |

FOREIGN PATENT DOCUMENTS

WO WO 02/80714 10/2002

OTHER PUBLICATIONS

PCT/US01/18087, International Search Report mailed May 30, 2003, 18 pages.

* cited by examiner

*Primary Examiner* — Tejash Patel
(74) *Attorney, Agent, or Firm* — Andrew F. Young, Esq.; Lackenbach Siegel, LLP

(57) ABSTRACT

An improved garment pocket system securely holds personal items with easy access to a touch screen feature of an electronic device. A garment includes a pocket system accessible from one or more garment surfaces allowing a user to store an external electronic device therein having a touch control surface. The pocket system includes an access panel which is an optically transmissive and control transmissive panel and a guiding system for receiving and positioning the touch control surface proximate the access panel for a user-access exterior to the pocket system. The improved garment pocket system may be retained proximate the garment surface or may externally descend from the garment surface for greater user control.

18 Claims, 9 Drawing Sheets

Fig. 13
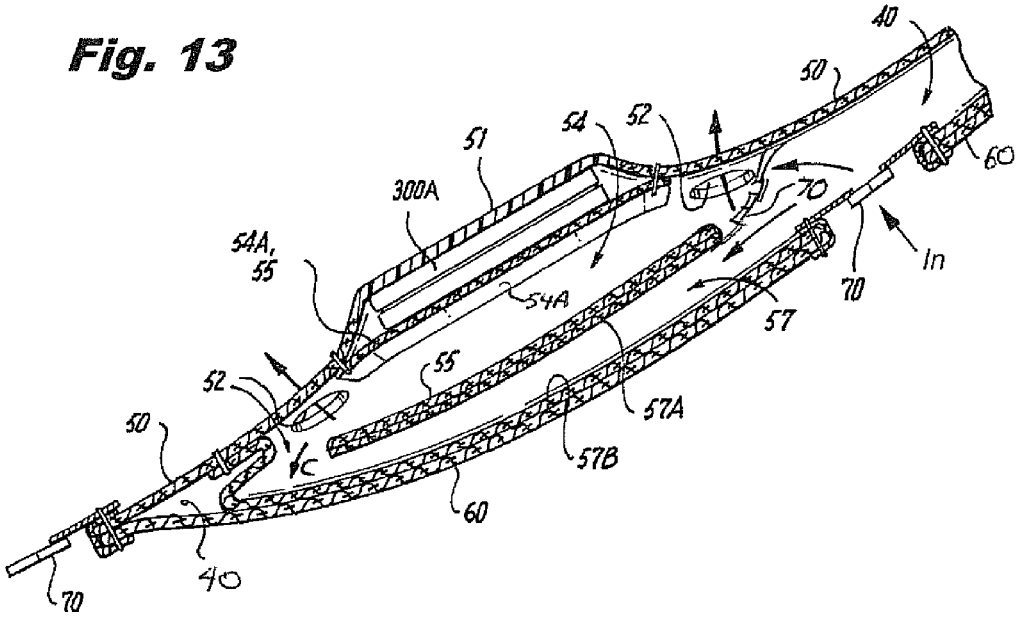
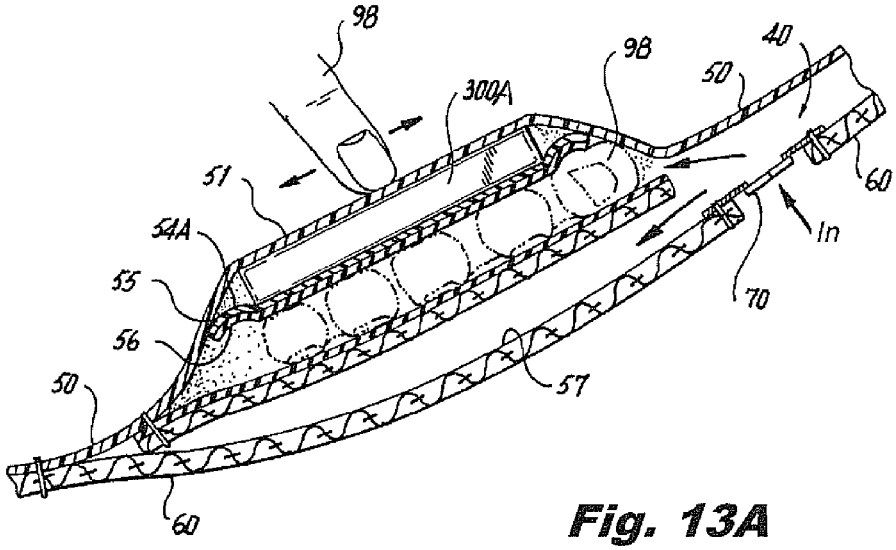
Fig. 13A

GARMENT POCKET SYSTEM FOR SECURELY HOLDING PERSONAL ITEMS WITH EASY ACCESS

BACKGROUND OF THE INVENTION

1. Field of the Invention

The present invention relates to a garment system for securely holding personal items with easy access. More particularly, the present invention provides a garment with a plurality of pocket systems that are adaptable for securely holding electronic devices with touch screens while shielding the device from external elements and allowing use without removal from the pocket systems.

2. Description of the Related Art

Industrial applications of a variety of innovative garment pocket systems are known from the related art, including U.S. Pat. No. 6,826,782 issued Dec. 7, 2004 (Jordan), now RE40, 613 (Jan. 6, 2009) and RE40,613 (certificate Jun. 7, 2011) [hereafter all collectively Jordan '613], the entire contents of which are incorporated herein by reference. Particular to Jordan '613 is the innovation of a plurality of innovative garment pockets creatively including a wire routing member as a passageway to aid, in one embodiment in enabling a user-wire to readily pass between a pocket and a user with improved convenience.

Another form of innovative garment pocket system is known from U.S. Prov. Ser. No. 61/538,519 filed Sep. 23, 2011 (Pereira and Jordan) [hereafter Pereira '519], the entire contents of which are incorporated herein by reference. Particular to Pereira '519 is a focus on pocket location being proximate the arm openings or sleeves of a user's garment.

In each application a plurality of adaptive garment pockets are provided with improved efficiencies a discussed therein.

Unfortunately, the rapidly growing need to both secure and readily access user electronic devices of all kind, most particularly those involving touch screen, has not been addressed by the conventional art. Nor to date has the conventional art provided any innovation to coordinate the greatly improved garment pocket technologies noted above by Jordan or Pereira with the need for secure and ready access to a device touch screen under a variety of circumstances and with improved user convenience.

Accordingly, there is a need for an improved garment pocket system for securely holding personal items with easy access. Further, there is also a need to provide an improved garment pocket system that is readily adapted to a variety of positions and configurations about a user-garment.

ASPECTS AND SUMMARY OF THE INVENTION

In response, it is now recognized that an improved garment pocket system with enhanced security and easy access is provided.

According to one aspect of the present invention, there is provided an improved garment pocket system securely holds personal items with easy access to a touch screen feature of an electronic device. A garment includes a pocket system accessible from one or more garment surfaces allowing a user to store an external electronic device therein having a touch control surface. The pocket system includes an access panel which is an optically transmissive and control transmissive panel and a guiding system for receiving and positioning the touch control surface proximate the access panel for a user-access exterior to the pocket system. The improved garment pocket system may be retained proximate the garment surface or may externally descend from the garment surface for greater user control.

According to another alternative and adaptive embodiment of the present invention, there is a pocket system providing a touch panel on an inner garment surface for an operative user-device access wherein the user device is insertable via an opening on an external garment surface.

According to another alternative and adaptive embodiment of the present invention, there is a pocket system providing a touch panel on an inner garment surface of an operative user-device access wherein the user device is insertable via an opening on an interior garment surface.

According to another alternative and adaptive embodiment of the present invention, there is a pocket system providing an a touch panel on an inner garment surface of an operative user-device access wherein the user device is insertable via both an opening on an interior garment surface and an opening on the exterior garment surface.

According to another alternative and adaptive embodiment of the present invention, there is a pocket system provided with a touch panel proximate a sleeve location wherein the touch panel is stored internally during a pre-use condition, between the inner garment surface and the outer garment surface between uses and is operatively extendable beyond one of said outer garment surface and said inner garment surface during an in-use condition.

According to another alternative and adaptive embodiment of the present invention, there is a pocket system provided with a touch panel and a sleeve location wherein there is at least one bounded access opening proximate said touch panel whereby a user may extend one or more digits form an interior of the pocket system proximate the sleeve for enhanced user security and reliability.

According to another alternative aspect of the present invention, there is provided a garment system, for securing an electronic device in a retained position and allowing an external operation of the electronic device during a use thereof while in the retained position, the garment system comprising: an outer garment surface and an inner garment surface bounding an interior passage therebetween and defining at least one user limb opening, at least one pocket system providing an operable pocket member having a main opening on one of the outer garment surface and the inner garment surface and extending into the interior passage therebetween and defining a bounded region of the operable pocket member, at least one touch panel member in the pocket system, the pocket system operable to secure the electronic device in the retained position proximate the touch panel member, the touch panel member being positioned on one of the inner garment surface and on an extending pocket portion extendable through the outer garment surface during the use, and the touch panel member being a material capable of transmitting an optical and an electronic instruction from an external user to the electronic device through the touch panel member to effectuate the external operation of the electronic device while the device is retained in the bounded region of the pocket system during the use thereof.

According to another alternative aspect of the present invention, there is provided a garment system, further comprising: a sleeve member proximate the touch panel member in the pocket system, whereby the sleeve member operably positions the electronic device proximate to the touch panel member during the use.

According to another alternative aspect of the present invention, there is provided a garment system, wherein: the touch panel member is on the extending pocket portion extendable through an extending opening on outer garment surface during the use, the extending opening is selectively openable for exposing the extending pocket portion from the interior passage away from the garment system during the use and for retracting the extending pocket portion during a non-use.

According to another alternative aspect of the present invention, there is provided a garment system, further comprising: a sleeve member proximate the touch panel member in the pocket system, whereby the sleeve member operably positions the electronic device proximate to the touch panel member during the use.

According to another alternative aspect of the present invention, there is provided a garment system, wherein: the main opening of the at least one pocket system is in one of an open passage communication and a selectively closable passage communication with the extended pocket portion.

According to another alternative aspect of the present invention, there is provided a garment system, further comprising: a means for positioning that includes a guiding seam system tapering a bounding device-passage from a position proximate an opening of the extending pocket portion to the sleeve member, whereby the guiding seam system enables a secure orientation of the electronic device during an insertion to proximate the touch panel member with increased accuracy.

According to another alternative aspect of the present invention, there is provided a garment system, further comprising: at least one digit opening in the extending pocket portion proximate the sleeve member, whereby the at least one digit opening enables an enhanced control of the electronic device.

According to another alternative aspect of the present invention, there is provided a garment system, further comprising: a wire guiding system proximate the interior passage between the interior garment surface and the exterior garment surface, and a plurality of wire openings providing a bounded access to the wire guiding system from locations proximate the at least one pocket system.

According to another alternative aspect of the present invention, there is provided a garment system, further comprising: a support layer proximate the sleeve member and approachable via the bounded region of the operable pocket member, whereby the support layer provides an enhanced stiffness to the sleeve member during a containing-use of the electronic device.

According to another alternative aspect of the present invention, there is provided a garment system, further comprising: an outer pocket and an inner pocket defined between the inner garment surface and the outer garment surface and within the bounded region of the operable pocket member, and the sleeve member proximate the touch panel member is on the inner pocket and joined to the inner garment surface, whereby the sleeve member operably positions the electronic device proximate to the touch panel member during the use.

According to another alternative aspect of the present invention, there is provided a garment system, further comprising: the touch panel member being on the inner garment surface and accessible through both the main opening on the exterior garment surface and an interior opening on the interior garment surface, whereby the touch panel member is accessible for installation of the electronic device during the use from both an exterior of the garment and an interior of the garment for enhanced convenience.

The above and other aspects, features and advantages of the present invention will become apparent from the following description read in conjunction with the accompanying drawings, in which like reference numerals designate the same elements.

BRIEF DESCRIPTION OF THE DRAWINGS

FIG. 13 is a partial sectional view along Section 13-13 in FIG. 11A wherein a hand warmer pocket is split between an outer pocket portion and an inner pocket portion for additionally containing a further narrow sleeve portion proximate a touch panel member on an inner garment surface. Alternative inner zipper options and thumb-or-digit holes for enhanced user interior and pocket access.

FIG. 13A is a different partial sectional view along Section 13A-13A of FIG. 12 wherein, in one alternative embodiment, a user's hand is shown urging the user's electronic device to tension a touch panel member for easy digit control of the same. Access to the region within the inner and outer garment layers is shown in this and other views.

DETAILED DESCRIPTION OF THE PREFERRED EMBODIMENTS

Figure 1:
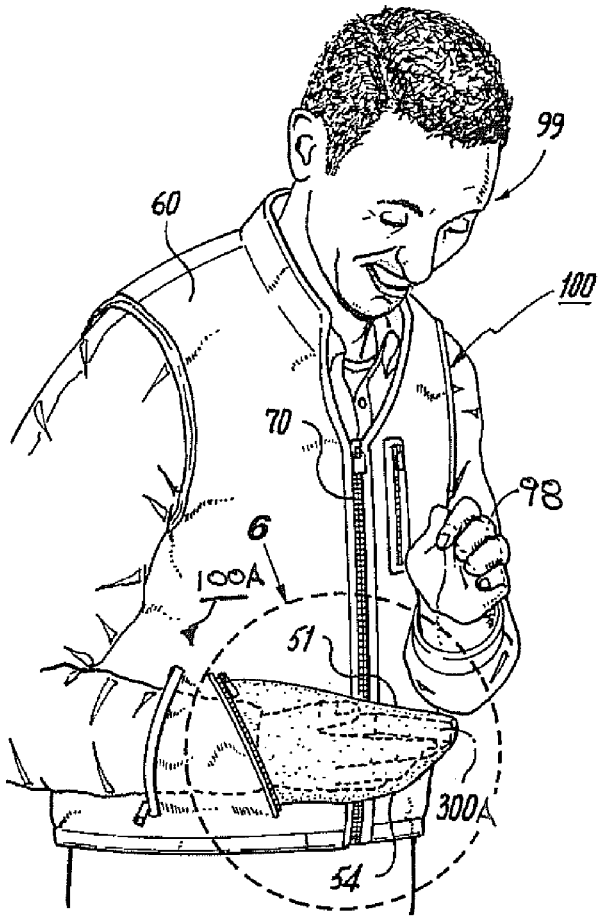
FIG. 1 is an illustrative perspective schematic of an innovative garment system noting chest and hand warmer locations, though other locations are included in the disclosure herein.
Figure 2:
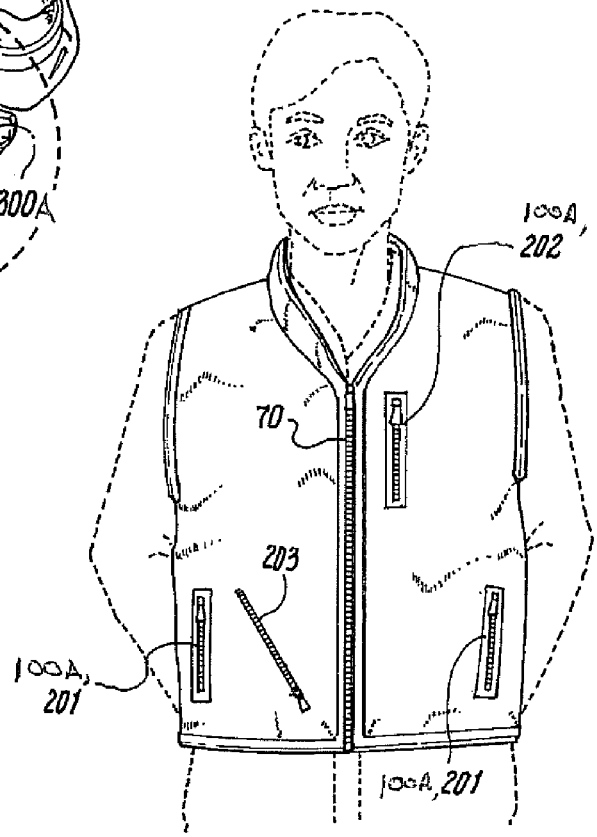
FIG. 2 is an illustrative front view of the schematic as shown in FIG. 1.
Figure 3:
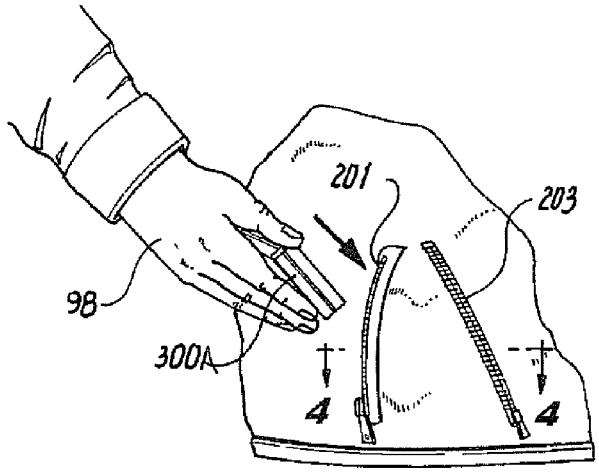
FIG. 3 is a close-up view of a portion of FIG. 1 prior to an insertion of a user's electronic device.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, in/out etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Various operations may be described as multiple discrete operations in turn, in a manner that may be helpful in understanding embodiments of the present invention; however, the order of description should not be construed to imply that these operations are order dependent.

Referring now to FIGS. 1 through 10 an innovative garment system 100 is provided with an adaptive pocket system 100A that is adaptable to a number of variations. A user 99 is provided with a pair of hands 98, 98, and the garment system 100 is provided with an inner garment surface 50 and an outer garment surface 60. A plurality of zippers 70 are provided to allow garment system 100 (and later garment systems 200, 300) to be removed and opened, and additionally to allow access to a variety of pocket systems, generally noted as a hand warmer pocket location 201 a chest pocket location 202, and in this alternative embodiment shown an extending pocket location 203 positioned proximate one alternative hand warmer pocket location 201, as shown.

Figure 4:
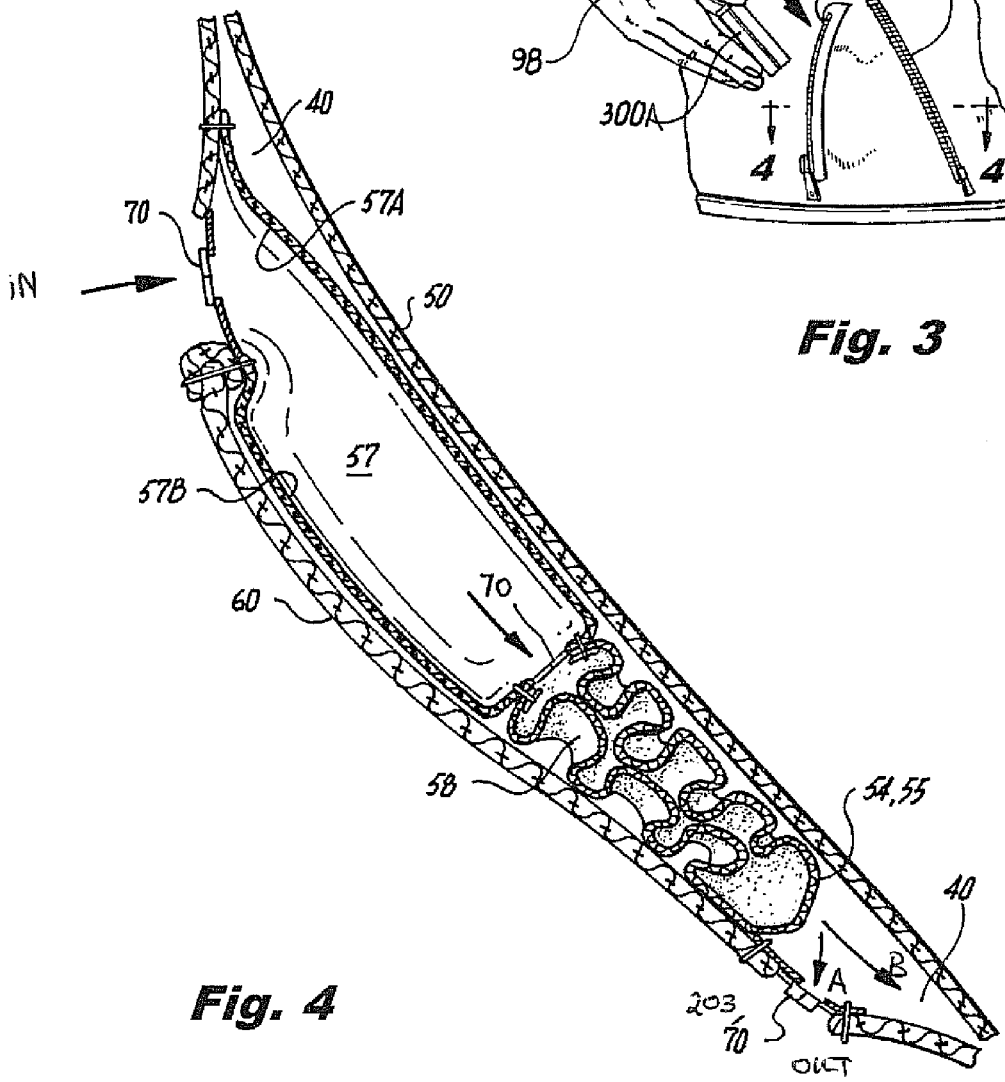
FIG. 4 is an illustrative partial cross-sectional view along Section 4-4 in FIG. 3.

As will be noted, for example in FIG. 4, there is an interior passage 40 or bounded region 40 defined between inner garment surface 50 and outer garment surface 60, thereby allowing a wire guiding system 303 (shown later) to allow passage of wires 301 (shown later) from user's electronic device to travel conveniently and securely to a plurality of wire openings 302 (shown later) for user convenience.

As will be noted in the various views throughout this disclosure a user's electronic device is noted as 300A, but is to be understood as being of any suitable size for transportation, and therefore not limited to a particular size. For an electronic device may be 'tablet sized' (size of a book or an iPad® etc.) or may be 'mini/micro/nano sized' (size of a match box or a size of an iPod-nano® etc.). Additionally, it will be understood that electronic device 300A will be operative via touch screen interface using any currently known or future invented technology sufficient to function in a touch-control manner within the scope and spirit of the present invention.

Referring particularly now to the adaptive pocket system shown in FIGS. 3-10 an extending pocket system is provided with a hand warmer pocket system 57 optionally closable via a zipper 70 for hand warming and having an inner layer 57A and an outer layer 57B, as shown. Interior to hand warmer pocket system 57 is a further inner electronic pocket 54 shown as a bunched-state pocket 58. It will be understood that inner pocket 54 is extendable and is formed of a textile 55 which is suitable for construction and may additionally include a touch panel member 51 joined therewith for providing an optical and electronic control of electronic device 300A.

It will be understood in use, that a user's limb 98 inserts device 300A into hand warmer pocket location 201 (FIG. 3) and into hand warmer pocket 57 (FIG. 4) a user may selectively and optionally open inner zipper member 70 and insert device 300A into inner pocket 54 in a loose fashion (FIG. 4, without sleeve 54A) or into a particularly formed device sleeve 54A joined to inner pocket 54 and providing an additional carry sleeve to contain device 300A. In either option, discussed later, an initial insertion step may extend bunched-state pocket 58 along direction B in FIG. 4 between the bounded region within inner and outer garment surfaces 50, 60.

In an optional embodiment, extending pocket access 203 is accessed by opening zipper 70 and via hand warmer pocket 57 extending bunched-state pocket 58 externally via a hand-urging-along direction A (FIG. 4) into an extended position (FIG. 5A) to allow an external access via touch panel member 51 external outer garment surface 60, as shown.

It will be understood that inner pocket 54 functions to contain device 300A in a variety of manners within the scope of the present invention. Optionally, following a full insertion by a user's hand 98 (FIG. 5B) the user may urge to the boundary of the textile layer 55 of pocket 54 and provide a tension along touch panel member 51 to smooth touch panel 51 proximate the control-face of device 300A (as shown).

Figure 5A:
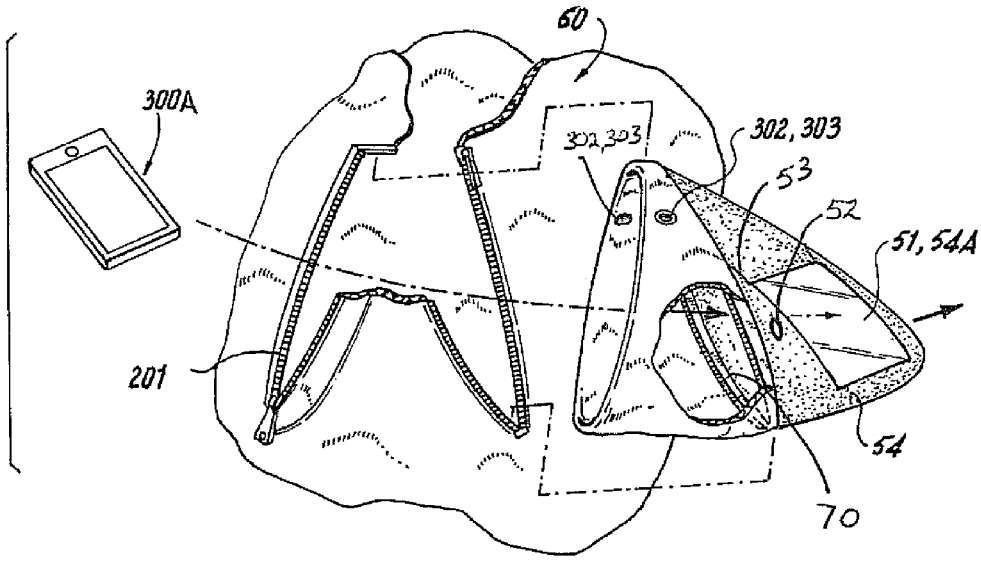
FIG. 5A is an exploded and cut-away partial view of FIG. 4 shown in an extended position from between the inner and outer garment surfaces to a position external to a garment during a use thereof.
Figure 5B:
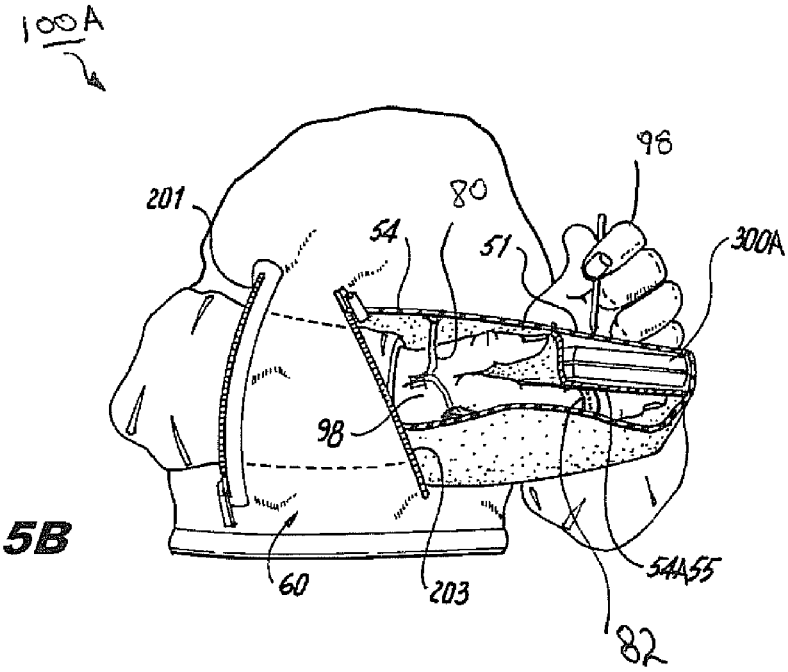
FIG. 5B is a partial cut-away view of FIGS. 4 and 5A with a user's hand inserted in a use-condition, including alternative constructions.

Alternatively, as is optionally and alternatively shown in FIG. 5B a tensioning system 80 is operably positioned about an inner portion of pocket 54 and including a tensioning clasp slidably securing a loop of material (e.g., a shock-cord system with a friction-spring clasp, shown but not numbered). Tensioning system 80 is operable in several ways. First, tensioning system 80 may be used to confine flaccid pocket 58 to prevent unintentional loss of electronic device 300A. Additionally, tensioning system 80 may be positioned on pocket 54 in a manner to squeeze pocket 54 material about electronic device 300A and thus urge device 300A to touch panel member location 51 as an aid in use. Still further, tensioning system 80 may be used in a partial-tension-condition to both aid retention of electronic device 300A while also aiding hand-securement (as shown by way of example in FIG. 5B). It will be understood by those of skill in the art that tensioning system 80 is an optional security feature and an aid in use within the scope and spirit of the present invention.

As an additional optional feature noted in FIG. 5B a retraction aid is provided as a hand or finger loop 82 (shown with hand inserted). As noted in FIG. 5B, retraction aid 52 is provided in this embodiment as a stitched loop member made of webbing material formed as a loop on textile layer 55/sleeve 54A and accessible to a users digit or hand upon insertion into pocket 54. Retraction aid 82 is provided as an aid for a user to single-handedly pull extended pocket 54 to inner passage 40 by hand warmer pocket location 201. This is an added convenience, so that a user need not use their alternative hand (as shown the user's left hand) to push pocket 54 into inner passage 40 (condition of FIG. 4). In this way, a single motion of a user's hand (shown as the right hand) can function to retract the user's device 300A and the entire pocket 54 for enhanced user convenience.

Additionally, it will be understood that the boundaries joining device sleeve 54A to the bounded opening of inner pocket 54 may be tapered from the opening dimension of inner pocket 54 to a dimension specific for receiving a particular electronic device 300A. For example, an inner opening may be 18 cm in length and may taper via seams to a dimension for sleeve 54A of 10 cm to fit the iPhone® or other electronic device 300A. In this way, a user can use tactile feel to insert electronic device 300A and guide the same via urging force to the bottom of sleeve 54A. Under this alternative construction, it will be understood that touch panel member 51 is joined to textile layer 55 in a position to cover the final location of the electronic device 300A.

For further user convenience, a plurality of wire openings 302 for wire guiding system 303 may be provided on a plurality of the inner surfaces of either hand warmer pocket 57 or inner pocket 54 to allow a wire-access from device 300A to interior passage 40 between inner and outer garment surfaces 50, 60 so as to pass wires (shown later) to remote wire openings 302.

Also for further user convenience, a plurality of digit holes 52 are positioned proximate sleeve 54A and allow a passage (optionally) of a user's digit (e.g., thumb or finger) proximate user device 300A for further control. In FIG. 5A a single hole 52 (e.g., bounded opening) is shown allowing an exterior projection of a digit extended beyond outer garment surface 60, but there is no restriction to location. In this way, digit-cramping is minimized during use, and further control is possible. For example, in FIG. 5B a digit hole (not shown) may be provided proximate the user's right thumb.

Obviously, during a use-cycle via pocket system 100A, the extended pocket access 203 is opened during a use to provide an external access to device 300A, and a user's external hand (shown, FIG. 5B), thereafter a user may return the inner pocket of this embodiment to the bunched state shown in 58 loosely proximate hand warmer pocket 57. An exemplary use cycle is noted in FIG. 8 where a user inserts device 300A via opening 201 and out opening 203 with device 300A being secured in sleeve 54.

Figure 6:
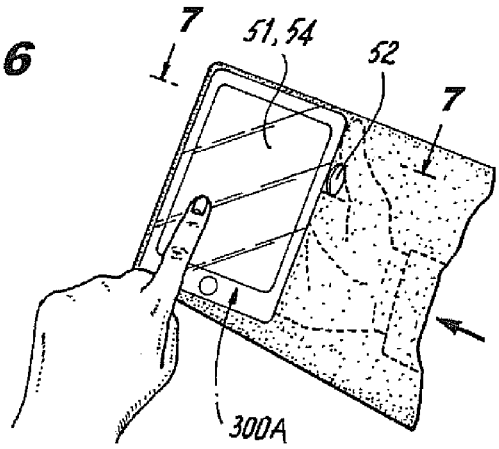
FIG. 6 is a partial extended view of region 6 in FIG. 1 showing a use-condition.
Figure 8:
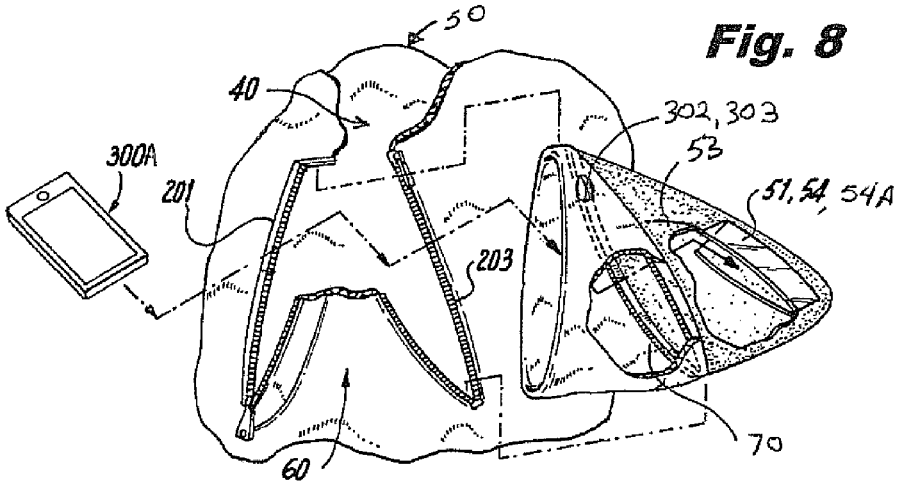
FIG. 8 is partial exploded and cut-away view similar to FIG. 5A wherein a device sleeve and optional inner zipper is noted.

Referring now to FIG. 6, an optional view is shown from a user-perspective of inner pocket member 54 extended external to outer garment surface 60 as in the condition shown in FIGS. 5B and 8. In this perspective, the user's hand (shown in shadow) is positioned to urge device 300A to touch panel member 51 allowing easy digital access while device 300A remains fully protected from inclement weather. An example of digit opening 52 is provided but it may be variously located.

Figure 7:
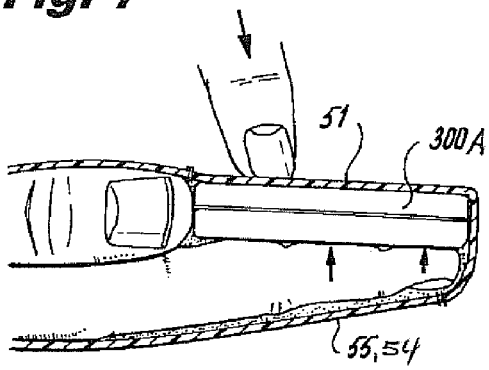
FIG. 7 is an alternative sectional view of Section 7-7 in FIG. 6 without a separate sleeve portion for holding a user's electronic device.
Figure 9:
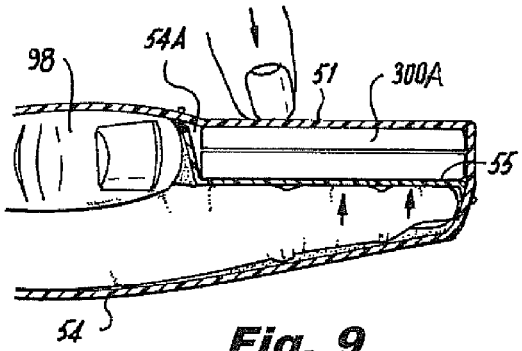
FIG. 9 is a further alternative sectional view along Section 7-7 in FIG. 6 wherein a specific electronic device sleeve (separate pocket) is provided for user convenience.
Figure 10:
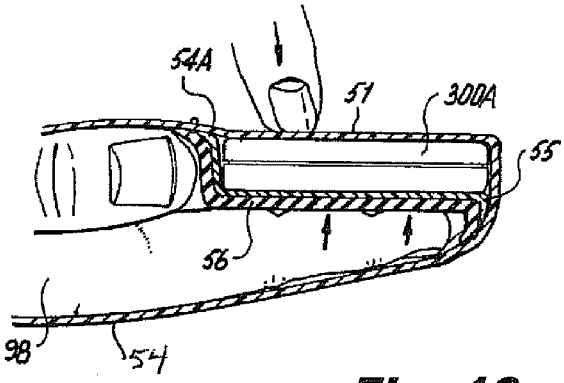
FIG. 10 is a further alternative sectional view along Section 7-7 in FIG. 6 wherein a specific device sleeve (separate pocket) is further backed by a thickened member (e.g., neoprene or other material) to provide a smoothing urging of the electronic device against the touch panel member.

Referring specifically now to FIGS. 7, 9, and 10, wherein a variety of cross sections relative to Section 7-7 in FIG. 6 are shown. These illustrations note an extended inner pocket member 54 containing device 300A, wherein the common textile shown as 55, is joined with material forming touch panel member 51. Touch panel member 51 may form all or a portion of inner pocket 54 depending upon construction without departing from the scope and spirit of the present invention.

In FIG. 7, there is no inner sleeve 54A provided, and a user merely urges device 300A against the region of pocket 54 formed of textile 55 that is formed of the touch panel material forming touch panel member 51.

In FIG. 9, a specific portion of pocket 54 is formed as sleeve 54A from textile 55 for positioning and containing device 300A proximate touch panel member 51A. In this way, one sleeve 54A, including further guiding seams 53 or narrowing seems 53 (See FIGS. 5 and 8) can both secure device 300A and allow a user to more readily slip device 300A into position.

Additionally as will be noted now in FIG. 10, extending pocket or inner pocket 54 (as shown here) is additionally provided with an inner neoprene layer or padded or support or stiffening layer 56 proximate sleeve 54A (e.g., support layer or stiffening layer 56). In this alternative embodiment, stiffening or support layer 56 aids a user in correctly positioning device 300A proximate touch panel 51 for enhanced security and ease of use. Support layer 56 aids users having smaller or difficult hand sizes in supporting and urging differently sized devices 300A (large/small etc.) to smoothly contact touch panel member 51. It will be understood that in all cases, and in any construction smoothly contacting the control surface of device 300A to the inner surface of touch panel member 51 allows a user's control and operation via an outer surface of touch panel member 51 to be greatly enhanced. Wrinkles in touch panel member 51 during use are not preferred.

It will be understood throughout the disclosure herein that textile layer 55, or later support portions 56 may be formed from any material suitable for the particular purpose required by the systems herein. For example, while 55 has been noted as a textile, instead material 55 could be a thin film functional as a textile as required by the systems herein. Similarly, touch panel member 51 may be (as noted below) any of a number of suitable materials for the required purpose herein.

Referring now specifically further to FIGS. 11A to 13A where an alternative garment system 200 includes an alternative pocket system 200A as will be discussed herein. As with the embodiments noted above, pocket system 200A is provided proximate hand warmer pocket location 201 but differently provides touch panel member 51 on inner garment surface 50, as shown, instead of having to extend an inner pocket portion external to the outer garment surface 60.

Figure 11A:
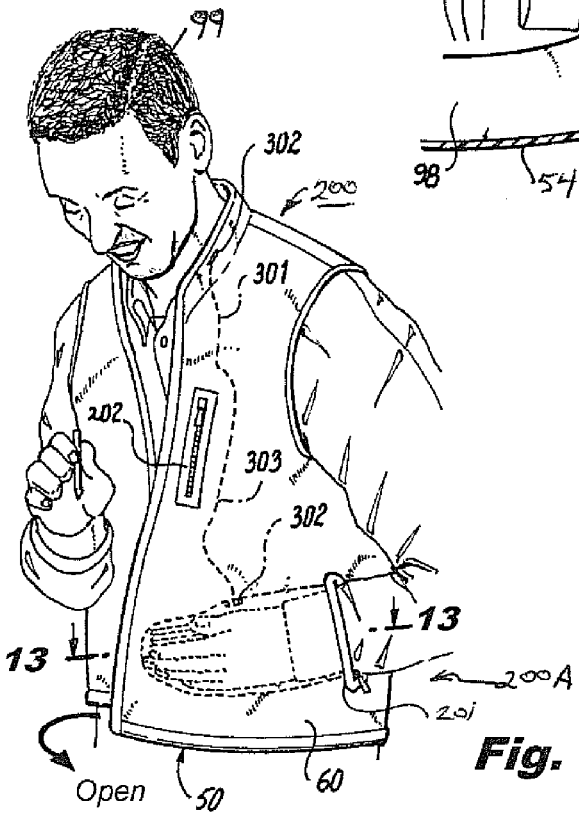
FIG. 11A is a perspective illustrative view of a further schematic of an innovative garment system wherein a pocket system includes a touch panel member internal to the garment in a wearing-position.
Figure 11B:
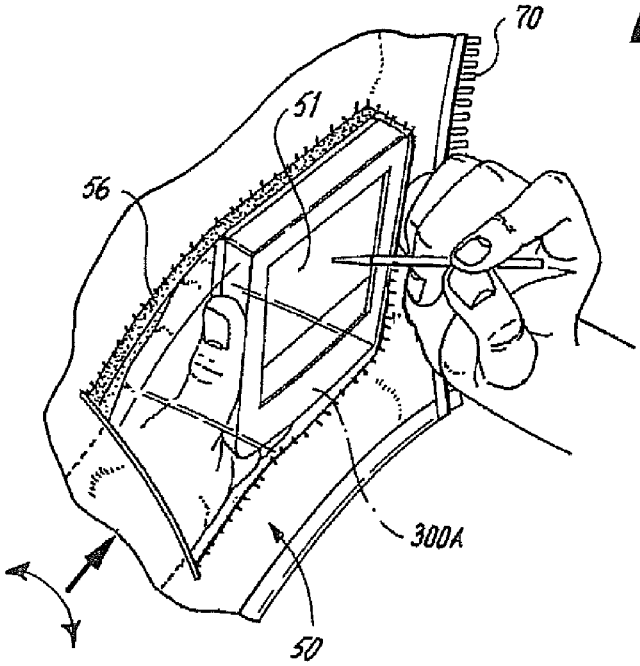
FIG. 11B is a partial perspective illustrative view of an inner portion of the garment system in FIG. 11A wherein an inner touch panel is readily accessible while the user's electronic device is retained within the inner garment surface and the outer garment surface.
Figure 12:
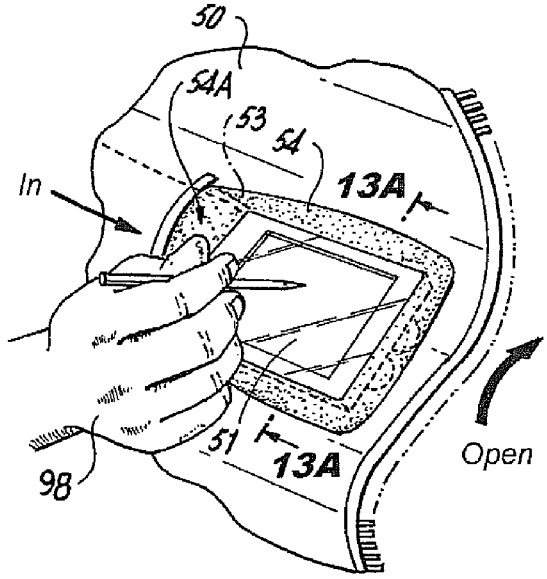
FIG. 12 is a partial perspective illustrative view of an inner portion of the garment system in FIG. 11A wherein a tapering tunnel system is shown for guiding a user's electronic device from an external position proximate an outer garment surface to a positioning and securing holding position in a sleeve on an inner garment surface having a touch panel member for touch-accessing the user's electronic device.

As will be noted particularly in FIGS. 11B and 12, touch panel member 51 is provided as jointed to inner garment surface 50 so that during a use, a user 99 unzips a main zipper 70 and turns-out/opens garment 200 allowing access to inner garment surface 50 proximate the exterior hand warmer pocket location 201. Thus, in use, a user's limb 98 is inserted into a hand warmer pocket and moved outwardly, away from the body thereby exposing the inner garment surface 50 and the touch panel member 51 positioned thereon.

Figure 14:
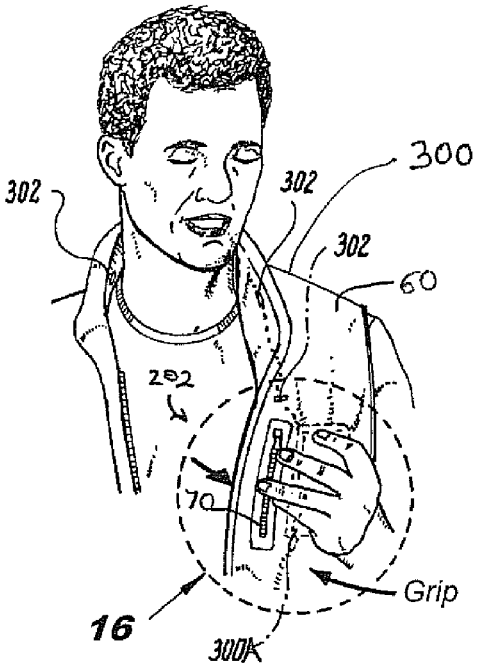
FIG. 14 is an illustrative perspective schematic of an innovative garment system noting a chest pocket system location on an outer garment surface.

As will be seen in FIGS. 12, 13, and 14 related constructions support the inventive embodiments regarding pocket system 200A. As shown an exterior pocket is provided with an opening in outer garment surface 60, selectively openable by a zipper 70 or by other means, although there is no requirement for such selective openability. Immediately upon entering pocket system 200A an outer hand warmer pocket 57 is provided with (optionally) an interior layer 57A and an exterior layer 57B bounding a general region referred to for convenience only as the 'outer' hand warmer pocket. An interior textile partition 55 further bounds and defines the device pocket 54 shown now on the 'interior' location. It is noted that while the earlier device pocket 54 (FIG. 5B for example) extended away from outer garment surface 60, in these embodiments (FIGS. 13, 14) the alternative device pocket 54 is on the interior surface location and is thus discussed similarly. Those of skill in the art will understand the similarities following study of the present disclosure.

Optionally, an additional device sleeve 54A is provided on device pocket 54 to closely support device 300A as shown proximate to touch panel 51 on the inner surface and joined with inner garment surface 50. In this way, as with the earlier pocket system 100A, the present pocket system 200A allows a user to receive, and position a device 300A proximate to touch panel 51 and allow operative control of device 300A from a location exterior to the particular pocket of discussion.

As will be noted in FIG. 13, an optional closure 70 (zipper) separates outer hand warmer pocket 57 from inner device pocket 54. This is to provide enhanced security for device 300A. Additionally, as noted earlier, thumb or digit holes 52 are provided at various locations and both allow a digit to project optionally through inner garment surface 50 to a 'user side' or through layer 55 toward outer hand warmer pocket 57 (See FIG. 13 by Arrow C). It will be additionally noted that one or more wire openings 302 (FIG. 11A) provide access to interior passage 40 between inner and outer garment surfaces 50, 60.

In FIG. 13A, a user's digits via hand 98 are shown pressing a support layer 56 proximate a textile layer 55 to urge device 300A into a smooth interfacing contact with touch panel member 51. Thus, as noted earlier, wire guiding system 303 is enabled via the present pocket system 200A to allow wires (not shown) from device 300A to access variously positioned wire openings 302. It is noted that wire openings 302 may be in multiple and adaptive positions and are not restricted to the single exemplary position noted in FIG. 11A.

Referring additionally now to FIGS. 14 to 17 an additional and further pocket system 400A on an exemplary garment 300 which includes several elements similar to earlier pocket systems 100A and 200A, although these elements are differently positioned as will be understood. As noted, pocket system 400A is provided as an example proximate chest pocket location 202.

Figure 15:
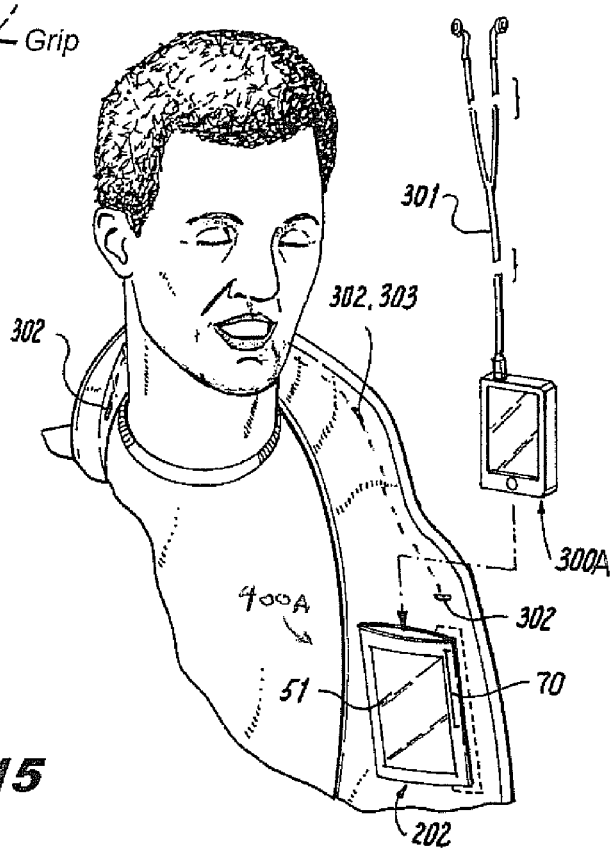
FIG. 15 is an illustrative perspective view of FIG. 14 wherein the garment system is partially opened noting an inner touch panel member on an inner garment surface. In this embodiment a user's electronic device is inserted via an inner pocket opening but it is also noted that the device may be inserted into the chest pocket system from the outer garment system via the disclosed zipper opening to a region between the inner garment surface and the outer garment surface.
Figure 16:
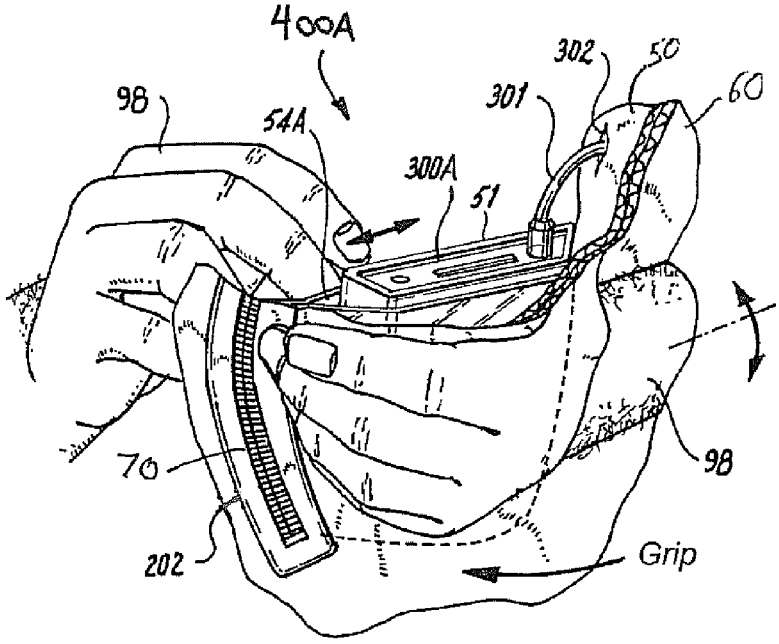
FIG. 16 is a partial perspective cut-away view along view 16 in FIG. 14 in an open position as in FIG. 15, where a user's exterior hand is shown gripping the outer garment surface, constraining the user's electronic device within a sleeve region and smoothing a touch panel member on the inner garment surface allowing the user's interior hand to control the user's electronic device from a secure position.
Figure 17:
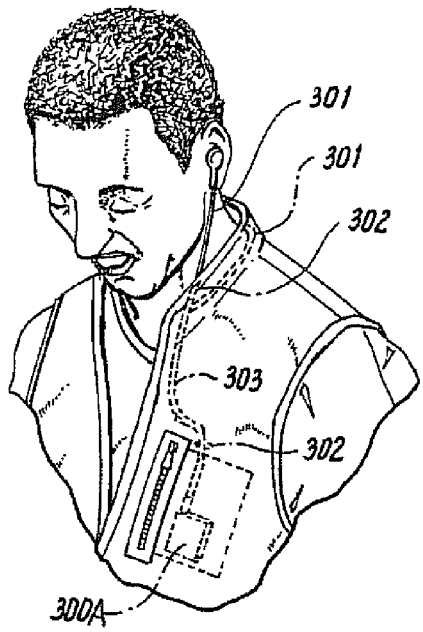
FIG. 17 is a simplified perspective view noting the inclusion of a user's electronic device on the pocket system's interior surface (similar to FIG. 16) and wherein wires with ear phones are shown via the wire guiding system being conveniently positioned from the user's electronic device along the region between the inner garment surface and outer garment surface and exiting via a convenient wire opening member.

In this alternative embodiment pocket system 400A includes an exterior access zipper 70 (FIG. 14) on outer garment surface 60 but may also be insertable into a bounded pocket on inner garment surface 50 (FIG. 15). In either embodiment, access to the inner garment surface 50 is provided via an inner pocket 54 formed generally between inner and outer garment surfaces 50, 60 and optionally accessible from either side. Pocket 54 is provided with touch panel 51 as discussed above so that in a use (FIGS. 14 and 16) a user's hand grips device 300A via outer garment surface 60 and urges the control surface on device 300A against the inner surface of touch panel member 51 (FIG. 16) thereby allowing a user to operate device 300A via an alternative hand on the inner garment surface 50 without exposing device 300A to inclement conditions.

As will be additionally understood, and as discussed earlier, a plurality of wire openings 302 are provided proximate pocket 43 and the location of device 300A to allow a direction of wires 301 into wire guiding system 303 positioned between inner and outer layers 50, 60. Indeed, should a user wish, a user may route, via wire guiding system 303 a wire 301 from any of the pocket locations into any wire opening and out any other wire opening without departing from the scope and spirit of the present invention.

It will be understood that the various pocket systems discussed herein are not restricted to the particular garment locations or to particular garments, but may be positioned widely and on differing garments without departing from the scope and spirit of the present invention. For example, while shown generally in a jacket/vest configuration, there is nothing preventing a location on pants, or on a shirt, or locations proximate arm-openings or lumbar locations.

It will be understood that the present illustrations of various pocket systems and constructions are not limited to the literal illustrations but may be of any size or shape enabling the claims and the concepts disclosed herein with the scope and spirit of the present invention. For example, the pocket systems and constructions herein may include alternative sizes; namely sufficient to contain a large-size full iPad® or other tablet of large size (30 cm×20 cm×2 cm) while also optionally adapted to sufficient to contain any type of small micro/nano-type (2 cm×2 cm×0.5 cm) device such as that used by athletes to play music during exercise. It will additionally be understood that the pocket systems and constructions herein may be accessible from multiple layers (e.g., three pockets or four pockets, or more, in one location, such as FIGS. 13, 13A including additional multiple layered pockets); or from multiple locations (e.g., cross-draw/under arm locations, lumbar/back locations, chest locations, hand-warmer locations, etc.); or accessible via internal or external zippers or openings with (interior to) a pocket or other through-opening or accessible via a further garment (e.g., outer shell pocket opening) as part of an overall garment system where an inner garment (e.g., thermal fleece vest) containing one or more of the proposed inventions therein is operably accessible from and joined to the 'further garment' (outer shell) as part of an overall garment system. For example, this last alternative concept (outer shell garment+inner garment fixed together, with one or both each having one of the inventions herein), are common in the cold-weather-gear fields where a user may reach through an outer-weather-shell (e.g., ski shell) to an inner fleece or insulated coat, where either or both of the outer shell garment and inner coat garment each have one or more of the proposed inventions herein.

Additionally, any of the embodiments herein may be further modified within the scope and spirit of the present invention to include adaptive features, including for example; fixed or removable reflectors, snaps, buttons, or magnetic closure or securing systems or embellishments of any kind, lockable zipper systems, removable zipper systems, or otherwise. Further embodiments may additionally include eyeglass holders loops (of small string), hook-and loop closures for any pocket or opening, spring-type securing clips for holding glasses or small note books, retractable or extendable key-rings or key-clips for securing a user's keys within a pocket of the garment.

It will be additionally recognized that while the exemplary embodiments discussed herein are shown as a jacket or vest or shirt for the upper body of a user, nothing herein is so restrictive, as the garment system and pocket systems herein may be readily adapted to a pant, a short, a skirt, or a dress type garment construction.

It will also be understood, that as used herein the phrases extendable, extending, descending, or inverting or exposing, etc. are to be understood as descriptive labels for a pocket system functionally able to storable retain a user electronic device between an inner and outer garment surface during pre-use and then being extendable outwardly—away from and out of a location between inner and outer garment surfaces—away from the garment by a user during an in-use position whereby the user can manipulate the user electronic device while shielding the device from exterior elements and without withdrawing the electronic device from the pocket. After use, the user may return the extendable pocket system to a location between the inner and outer garment surfaces for enhanced safety and convenience.

It will also be understood herein, that the phrase wire guiding system will is inclusive of the concepts incorporated herein by reference earlier, wherein wire or wires from a user's electronic device may be guided proximate a pocket container the user's electronic device along a cavity between the inner and outer surface of the garment to one or more wire openings proximate a user-wire-desire exit region for enhanced user convenience. There may be multiple wire guiding systems and wire openings for enhanced ability. There may be further wire guiding members or wire securing systems within the scope of the concepts incorporated herein by reference. All such wire guiding aspects are incorporated into this disclosure without departing from the scope and spirit of the present invention.

It will also be understood that the phrase 'opening' regarding wire will be interpreted broadly and without restriction and will include, for a user's electronic device, or hand or other feature an opening or pocket or otherwise is to be recognized as generally a bounded portal of any shape allowing something to enter or exit there through either partially or wholly.

It will also be understood that a user limb opening will be broadly interpreted to be an arm, leg, neck opening, but may additionally and alternatively be a pocket opening so that in use the garment could be a scarf garment for wrapping about a user while a pocket opening allows a limb (hand) to access the pocket systems discussed herein without departing from the scope and spirit of the present invention.

As noted above and herein, it is important for the proper functioning of the touch panel for the touch panel to be fabricated from a material that is sufficiently suitable for the particular purposes of allowing optical transmission (to allow a user to see a user's electronic device) and electronic transmission (understood inclusively as allowing transfer of a touch-screen instruction via the touch panel including electronic capacitance ability, electronic resistance ability, electronic pressure sensitive ability, and in any other way developed now and in the future to transfer a user's manual instruction to a form recognized by a user's electronic device. Therefore, the touch panel is to be understood as being formed from any suitable material for the purpose, including but not limited to the flexible polymers, a doped polymer, a thermoplastic or elastomeric material; exemplary materials include thermoplastic polyurethane, flexible polypropylene, low/medium/high density polyethylene, flexible polyvinyl chloride, and nylon.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A garment system, for securing an electronic device in a retained position and allowing an external operation of said electronic device during a use thereof while in said retained position, said garment system comprising:

an outer garment surface and an inner garment surface bounding an interior passage therebetween and defining at least one user limb opening;

at least one pocket system providing an operable pocket member having a main opening on one of said outer garment surface and said inner garment surface and extending into said interior passage therebetween and defining a bounded region of said operable pocket member;

at least one touch panel member in said pocket system;

said pocket system operable to secure said electronic device in said retained position proximate said touch panel member;

said touch panel member, during said use, being positioned on one of (i) an extending pocket portion extendable through an extending opening on said outer garment surface, and (ii) said inner garment surface; and said touch panel member being a material capable of transmitting an optical and an electronic instruction from an external user to said electronic device through said touch panel member to effectuate said external operation of said electronic device while said device is retained in said bounded region of said pocket system during said use thereof.

2. The garment system, according to claim 1, further comprising:

a sleeve member proximate said touch panel member in said pocket system, whereby said sleeve member operably positions said electronic device proximate to said touch panel member during said use.

3. The garment system, according to claim 1, wherein:

said touch panel member is on said extending pocket portion extendable through said extending opening on outer garment surface during said use;

said extending opening is selectively openable for exposing said extending pocket portion from said interior passage away from said garment system during said use and for retracting said extending pocket portion during a non-use.

4. The garment system, according to claim 3, further comprising:

a sleeve member proximate said touch panel member in said pocket system, whereby said sleeve member operably positions said electronic device proximate to said touch panel member during said use.

5. The garment system, according to claim 4, wherein:

said main opening of said at least one pocket system is in one of an open passage communication and a selectively closable passage communication with said extended pocket portion.

6. The garment system, according to claim 5, further comprising:

means for positioning said electronic device proximate said touch panel member in said pocket system.

7. The garment system, according to claim 6, wherein:

said means for positioning includes a guiding seam system tapering a device-passage from a position proximate an opening of said extending pocket portion to said sleeve member, whereby said guiding seam system enables a secure orientation of said electronic device during an insertion to proximate said touch panel member with increased accuracy,

8. The garment system, according to claim 7, further comprising:

at least one digit opening in said extending pocket portion proximate said sleeve member, whereby said at least one digit opening enables an enhanced control of said electronic device.

9. The garment system, according to claim 2, further comprising:

a wire guiding system proximate said interior passage between said interior garment surface and said exterior garment surface; and a plurality of wire openings providing a bounded access to said wire guiding system from locations proximate said at least one pocket system.

10. The garment system, according to claim 4, further comprising:

a support layer proximate said sleeve member and approachable via said bounded region of said operable pocket member, whereby said support layer provides an enhanced stiffness to said sleeve member during a containing-use of said electronic device.

11. The garment system, according to claim 1, wherein:

said touch panel member is on said inner garment surface and accessible through said main opening on said exterior garment surface.

12. The garment system, according to claim 11, further comprising:

an outer pocket and an inner pocket defined between said inner garment surface and said outer garment surface and within, said bounded region of said operable pocket member; and said sleeve member proximate said touch panel member on said inner pocket and joined to said inner garment surface, whereby said sleeve member operably positions said electronic device proximate to said touch panel member during said use.

13. The garment system, according to claim 12, wherein:

said main opening of said at least one pocket system is in one of an open passage communication and a selectively closable passage communication with said extended pocket portion; and an inner selectively closable passage is positioned between said inner pocket and said outer pocket.

14. The garment system, according to claim 13, further comprising:

means for positioning said electronic device proximate said touch panel member in said pocket system.

15. The garment system, according to claim 14, wherein:

said means for positioning includes a guiding seam system tapering a device-passage from a position proximate an opening of said inner selectively closable passage to said sleeve member, whereby said guiding seam system enables a secure orientation of said electronic device during an insertion to proximate said touch panel member with increased accuracy.

16. The garment system,. according to claim 15, further comprising:

at least one digit opening in said inner pocket proximate said sleeve member, whereby said at least one digit opening enables an enhanced control of said electronic device.

17. The garment system, according to claim 11, further comprising:

said touch panel member being on said inner garment surface and accessible through both said main opening on said exterior garment surface and an interior opening on said interior garment surface, whereby said touch panel member is accessible for installation of said electronic device during said use from both an exterior of said garment and an interior of said garment for enhanced convenience.

18. A garment system, for securing an electronic device in a retained position and allowing an external operation of said electronic device during a use thereof while in said retained position, said garment system comprising:

an outer garment surface and an inner garment surface bounding an interior passage therebetween and defining at least one user limb opening;

at least one pocket system providing an operable pocket member having a main opening on one of said outer garment surface and said inner garment surface and extending into said interior passage therebetween and defining a bounded region of said operable pocket member;

at least one touch panel member in said pocket system;

said pocket system operable to secure said electronic device in said retained position proximate said touch panel member;

a sleeve member proximate said touch panel member in said pocket system, whereby said sleeve member operably positions said electronic device proximate to said touch panel member during said use.

said touch panel member, during said use, being positioned. on one of (i) an extending pocket portion extendable through an extending opening on said outer garment surface, and (ii) said inner garment surface; and said touch panel member being a material capable of transmitting an optical and an electronic instruction from an external user to said electronic device through said touch panel member to effectuate said external operation of said electronic device while said device is retained in said bounded region of said pocket system during said use thereof.

* * * * *